United States Patent [19]

Wu

[11] Patent Number: 4,978,141

[45] Date of Patent: Dec. 18, 1990

[54] INFLATABLE INTELLIGENCE ALBUM

[76] Inventor: Kuang-Ping Wu, Fl. 5, No. 19, Lane 595, Pei An Rd., Taipei, Taiwan

[21] Appl. No.: 496,780

[22] Filed: Mar. 21, 1990

[51] Int. Cl.[5] ..... B42D 1/00

[52] U.S. Cl. ..... 281/15.1; 281/51; 281/3.1; D19/26

[58] Field of Search ..... 281/15.1, 51, 3.1; 40/212, 214, 124.1; 446/224, 222, 220, 153; 434/254, 393, 433; D19/26; D21/59

[56] References Cited

U.S. PATENT DOCUMENTS

| | | | |
|---|---|---|---|
| 3,686,782 | 8/1972 | Erickson et al. | 446/220 |
| 3,740,128 | 6/1973 | Adler | 281/15.1 |
| 3,771,247 | 11/1973 | De Harak | 40/212 |
| 4,577,889 | 3/1986 | Schulz | 281/15.1 |
| 4,758,198 | 7/1988 | Ishiwa | 446/220 |
| 4,819,963 | 4/1989 | Wolski | 281/15.1 |
| 4,909,542 | 3/1990 | Marks | 281/15.1 |

*Primary Examiner*—Douglas D. Watts
*Assistant Examiner*—Hwei-Siu Payer
*Attorney, Agent, or Firm*—Morton J. Rosenberg; David I. Klein

[57] ABSTRACT

This invention relates to an inflatable intelligence album including an inflatable ring formed with a check valve through which air may be blown therein to expand the inflating ring thereby enabling the inflatable ring to float on water surface and a plurality of leaves each of them completely sealed by a plastic bag with a sheet of sponge therein, whereby the children may play and read the album even in a bath tub.

1 Claim, 3 Drawing Sheets

INFLATABLE INTELLIGENCE ALBUM

BACKGROUND OF THE INVENTION

It is found that the conventional painting book for children is only designed for use on land cannot be read in water. However, most children are interested in playing water and so it will be much helpful to teach children when they are playing water.

It is, therefore, an object of the present invention to provide an inflatable intelligence album which may be read and played in water.

SUMMARY OF THE INVENTION

This invention relates to an inflatable intelligence album for children.

It is the primary object of the present invention to provide an inflatable intelligence album which may be a toy for children.

It is another object of the present invention to provide an inflatable intelligence album which may be used to teach the children.

It is still another object of the present invention to provide an inflatable intelligence album which may be read in a bath tub.

It is still another object of the present invention to provide an inflatable intelligence album which is safe in playing.

It is still another object of the present invention to provide an inflatable intelligence album which is durable in use.

Other objects and merits and a fuller understanding of the present invention will be obtained by those having ordinary skill in the art when the following detailed description has been read in conjunction with the accompanying drawings.

DETAILED DESCRIPTION OF THE PREFERRED EMBODIMENT

Figure 1:
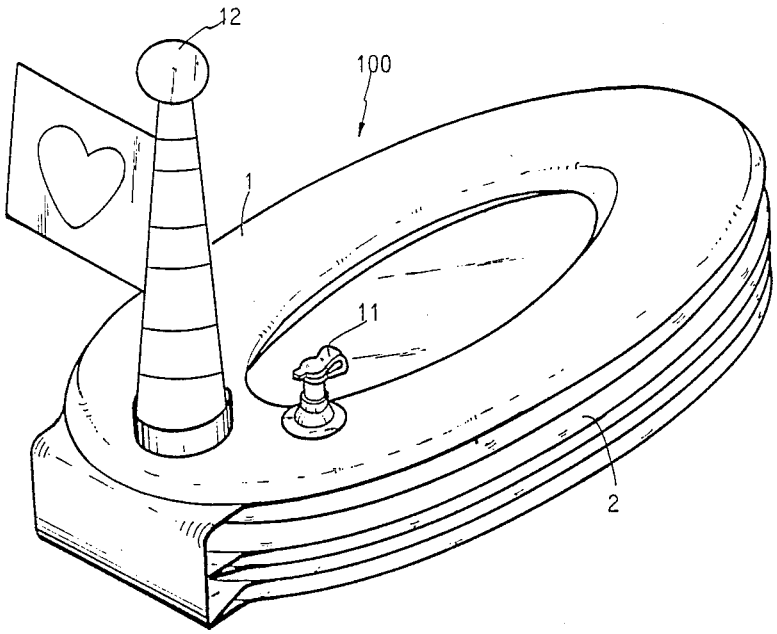
FIG. 1 is a perpective view of an inflatable intelligence album for children according to the present invention.
Figure 2:
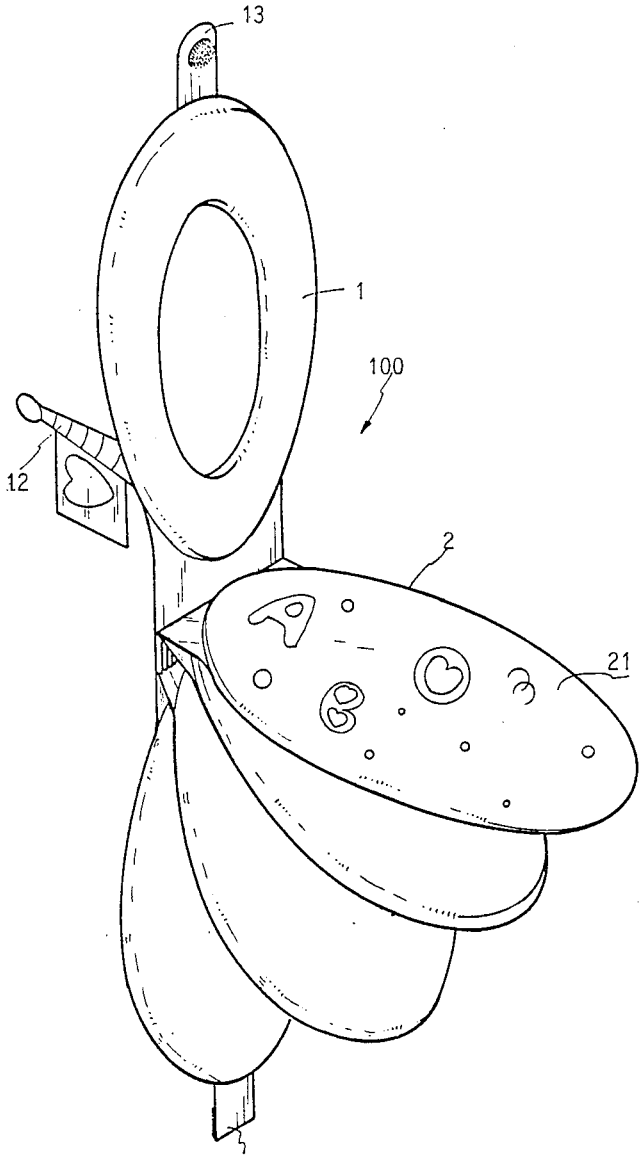
FIG. 2 shows the interior of the inflatable intelligence album for children.
Figure 3:
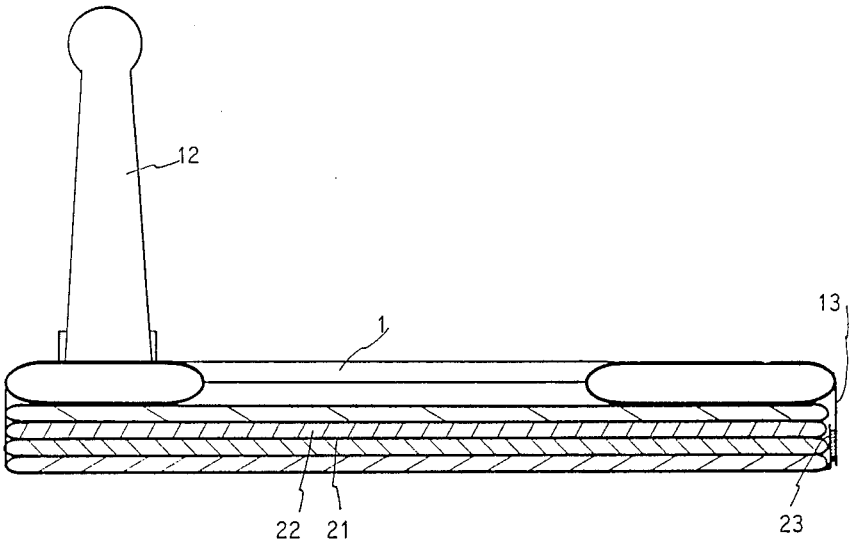
FIG. 3 is a sectional view of the inflatable intelligence album for children.

With reference to the drawings and in particular to FIGS. 1 and 2, the inflatable intelligence album 100 for children according to the present invention comprises a floating ring 1 and a plurality of leaves 2. The floating ring 1 is an inflatable annular pocket formed with a nozzle 11 through which air may be blown therein to expand the floating ring thereby enabling the floating ring 1 to float on the water surface. The nozzle 11 is actually a check valve so that the air will not flow back from the floating ring 1 into the mouth of the blower. The principle of the nozzle 11 is well known in the art and has no need to be described here in detail. Further, the floating ring 1 has a male Velcro strap 13 at the tip and the lowest leave 2 has a female Velcro strap 23 at a corresponding position and so the leaves 2 may be bound together. In addition, a flag 12 is mounted on the front end of the floating ring 1 as an ornament and may cause the floating ring 1 to look like a boat hence increasing the learning interest.

Each of the leaves 2 is a completely sealed plastic bag 21 with a sheet of sponge therein, on each surface of which may be printed a drawing illustrating stories, alphabets, arithmatics . . . etc. The leaves 2 are welded at one end with the floating ring 1 by heating so that the leaves 2 may be bound together with the floating ring 1 by engaging the Velcro straps 13 and 23.

It is understood, however, that the shape of the floating ring 1 may be modified in accordance with the contents printed on the surface of the leaves 2. For example, if the contents depicted on the leaves 2 are related to a fish, then the floating ring 1 may be shaped as a fish or the like, thus enhancing the learning interest of the children.

Although the present invention has been described with a certain degree of particularity, it is understood that the present disclosure is made by way of example only and that numerous changes in the construction and the combination and arrangement of parts may be resorted to without departing from the spirit and scope as hereinafter claimed.

I claim:

1. An inflatable intelligence album comprising:

a plurality of leaves having indicia thereon and being coupled one to the other on one end thereof to define a book-like structure, each of said leaves being defined by a sheet of sponge material completely sealed within a plastic bag; and, an inflatable ring coupled to said plurality of leaves on one end thereof for overlaying an uppermost one of said plurality of leaves, said inflatable ring being inflated by a check valve formed thereon, whereby said inflatable ring provides floating for use in water of said intelligence album.

* * * * *